US006554565B2

(12) United States Patent
Suzuki et al.

(10) Patent No.: US 6,554,565 B2
(45) Date of Patent: Apr. 29, 2003

(54) FLUID PUMP DEVICE HAVING FILTER

(75) Inventors: Akihiro Suzuki, Kosai (JP); Yasuhiro Harita, Kosai (JP)

(73) Assignee: Asmo Co., Ltd., Shizuoka (JP)

( * ) Notice: Subject to any disclaimer, the term of this patent is extended or adjusted under 35 U.S.C. 154(b) by 0 days.

(21) Appl. No.: 09/986,314

(22) Filed: Nov. 8, 2001

(65) Prior Publication Data

US 2002/0064454 A1 May 30, 2002

(30) Foreign Application Priority Data

Nov. 27, 2000 (JP) ..... 2000-359414

(51) Int. Cl.[7] ..... F03B 11/08

(52) U.S. Cl. ..... 415/121.2; 415/169.1; 417/423.9; 239/284.1; 210/416.1

(58) Field of Search ..... 415/121.2, 169.1, 415/121.6; 417/423.9; 210/416.1, 413; 239/284.1, 575, 540, 590.3

(56) References Cited

U.S. PATENT DOCUMENTS 4,824,021 A 4/1989 Binder
5,853,580 A * 12/1998 Rusinol et al. ..... 210/172
5,937,879 A * 8/1999 Payzant
6,213,726 B1 * 4/2001 Tuckey ..... 417/199.1
6,423,221 B1 * 7/2002 Kohlhaas et al. ..... 210/232

* cited by examiner

*Primary Examiner*—Edward K. Look
*Assistant Examiner*—James M McAleenan
(74) *Attorney, Agent, or Firm*—Law Offices of David G. Posz

(57) ABSTRACT

In a fluid pump device, a filter is secured to a housing. A meshed portion of the filter substantially covers an inlet opening of the housing. Each engaging projection of the filter is engaged with a corresponding engaging recess of the housing in a direction perpendicular to an axial direction of an impeller. Arm portions of the filter substantially perpendicularly extend with respect to a meshed portion of the filter and are resiliently flexible in the direction perpendicular to the axial direction of the impeller. Each coupling projection of the filter is provided between adjacent two arm portions of the filter and is engaged with a corresponding coupling recess of the housing in the axial direction of the impeller.

9 Claims, 5 Drawing Sheets

FLUID PUMP DEVICE HAVING FILTER

CROSS REFERENCE TO RELATED APPLICATION

This application is based on and incorporates herein by reference Japanese Patent Application No. 2000-359414 filed on Nov. 27, 2000.

BACKGROUND OF THE INVENTION

1. Field of the Invention

The present invention relates to a fluid pump device that suctions fluid through an inlet opening via a filter and then discharges it through an outlet opening.

2. Description of Related Art

As shown in FIG. 8, one previously proposed fluid pump device installed, for example, in a windshield washer apparatus of a vehicle includes a housing 52 and a filter 53. The housing 52 receives a motor 51 that rotates an impeller (not shown).

The filter 53 includes a pipe portion 54, a flange portion 55 and a meshed portion 56. The flange portion 55 is formed at a base end of the pipe portion 54. The meshed portion 56 is formed at a distal end of the pipe portion 54. The meshed portion 56 includes a meshed end wall portion 56*a* and a meshed peripheral wall portion 56*b*. The meshed end wall portion 56*a* has through holes penetrating therethrough in an axial direction of the pipe portion 54. The meshed peripheral wall portion 56*b* has through holes penetrating therethrough in a radial direction of the pipe portion 54.

The base end of the pipe portion 54 is received through an inlet opening 52*a* formed in the housing 52, and the flange 55 engages with a peripheral area of the inlet opening 52*a* located around the inlet opening 52*a* to prevent detachment of the flange 55 from the housing 52, so that the filter 53 is secured to the housing 52. The pipe portion 54 receives a suction tube P therein. The suction tube P extends distally from a pump chamber 52*b* that receives the impeller (not shown) to a point adjacent the meshed portion 56.

The fluid pump device is installed in the windshield washer apparatus in such a manner that a distal half of the pipe portion 54 is inserted inside of a tank 57 of the windshield washer apparatus. When the motor 51 is driven to rotate the undepicted impeller, washer fluid received in the tank 57 is suctioned into the pump chamber 52*b* through the filter 53 (meshed portion 56) as well as through the suction tube P and is then discharged out of the pump chamber 52*b* through an outlet opening 52*c*. During this operation, the washer fluid from which debris and other undesirable foreign objects are removed through the meshed portion 56 is suctioned into the pump chamber 52*b*. Thus, the fluid pump device is protected from clogging with the debris and the other undesirable foreign objects suctioned therein.

However, the fluid pump device needs to suction the washer fluid received in the tank 57 through the elongated suction tube P (elongated pipe portion 54), resulting in a disadvantageously low operating efficiency of the fluid pump device. Furthermore, the distal end of the filter 53 (pipe portion 54) largely protrudes from the housing 52, so that a size of the device becomes disadvantageously large in the direction of the protrusion. Furthermore, the meshed portion 56 includes the meshed end wall portion 56*a*, which has the through holes penetrating therethrough in the axial direction of the pipe portion 54, and the meshed peripheral wall portion 56*b*, which has the through holes penetrating therethrough in the radial direction of the pipe portion 54. Thus, it is difficult to mold the meshed portion 56 with molds, resulting in an increase in a manufacturing cost. Furthermore, the tube portion 54 of the filter 53 needs to be inserted in the inlet opening 52*a* of the tank 57. Thus, even if the meshed portion 56 is not required (if removal of the debris and the other undesirable foreign objects from the washer fluid is not required), the expensive filter 53 that has the meshed portion 56 needs to be used, or alternatively a new tube component without the meshed portion 56 needs to be produced and installed.

SUMMARY OF THE INVENTION

The present invention addresses the above disadvantages. Thus, it is an objective of the present invention to provide a fluid pump device that has a filter and is capable of achieving a higher operating efficiency, a reduced size and a lower manufacturing cost.

To achieve the objective of the present invention, there is provided a fluid pump device that includes an impeller, a housing and a filter. The impeller creates a flow of fluid upon rotation of the impeller about its rotational axis. The housing receives the impeller therein and has an inlet opening, at least one housing side engaging portion and at least one housing side coupling portion. The inlet opening is formed at one axial end of the housing. The flow of the fluid moves into the housing through the inlet opening. The filter is secured to the housing and has a meshed portion, at least one filter side engaging portion and at least one filter side coupling portion. The meshed portion is communicated with the inlet opening of the housing to filter the fluid. The meshed portion substantially covers the inlet opening of the housing. The at least one filter side engaging portion is engaged with the at least one housing side engaging portion in a direction perpendicular to an axial direction of the impeller and also in a circumferential direction of the impeller by installing the filter to the housing in the axial direction of the impeller. The at least one filter side coupling portion is engaged with the at least one housing side coupling portion in the axial direction of the impeller by installing the filter to the housing in the axial direction of the impeller. The filter is secured to the housing upon engagement between the at least one filter side engaging portion and the at least one housing side engaging portion and also upon engagement between the at least one filter side coupling portion and the at least one housing side coupling portion.

To achieve the objective of the present invention, there may be alternatively provided a fluid pump device that includes an impeller, a housing and a filter. The impeller creates a flow of fluid upon rotation of the impeller about its rotational axis. The housing receives the impeller therein and has an inlet opening, at least one housing side engaging portion and at least one housing side coupling portion. The inlet opening is formed at one axial end of the housing. The flow of the fluid moves into the housing through the inlet opening. The at least one housing side engaging portion is formed at the one axial end of the housing to extend in an axial direction of the impeller. The at least one housing side coupling portion is formed in an outer peripheral surface of the housing to extend in a direction perpendicular to the axial direction of the impeller. The filter is secured to the housing and has a meshed portion, at least one filter side engaging portion, at least one arm portion and at least one filter side coupling portion. The meshed portion is communicated with the inlet opening of the housing to filter the fluid. The meshed portion substantially covers the inlet opening of the housing. The at least one filter side engaging portion is engaged with the at least one housing side engaging portion in the direction perpendicular to the axial direction of the impeller. The at least one arm portion substantially, perpendicularly extends with respect to the meshed portion of the filter and is resiliently flexible in the direction perpendicular to the axial direction of the impeller. The at least one filter side coupling portion is provided to the at least one arm portion and is engaged with the at least one housing side coupling portion in the axial direction of the impeller. The filter is secured to the housing upon engagement between the at least one filter side engaging portion and the at least one housing slide engaging portion and also upon engagement between the at least one filter side coupling portion and the at least one housing side coupling portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 2:
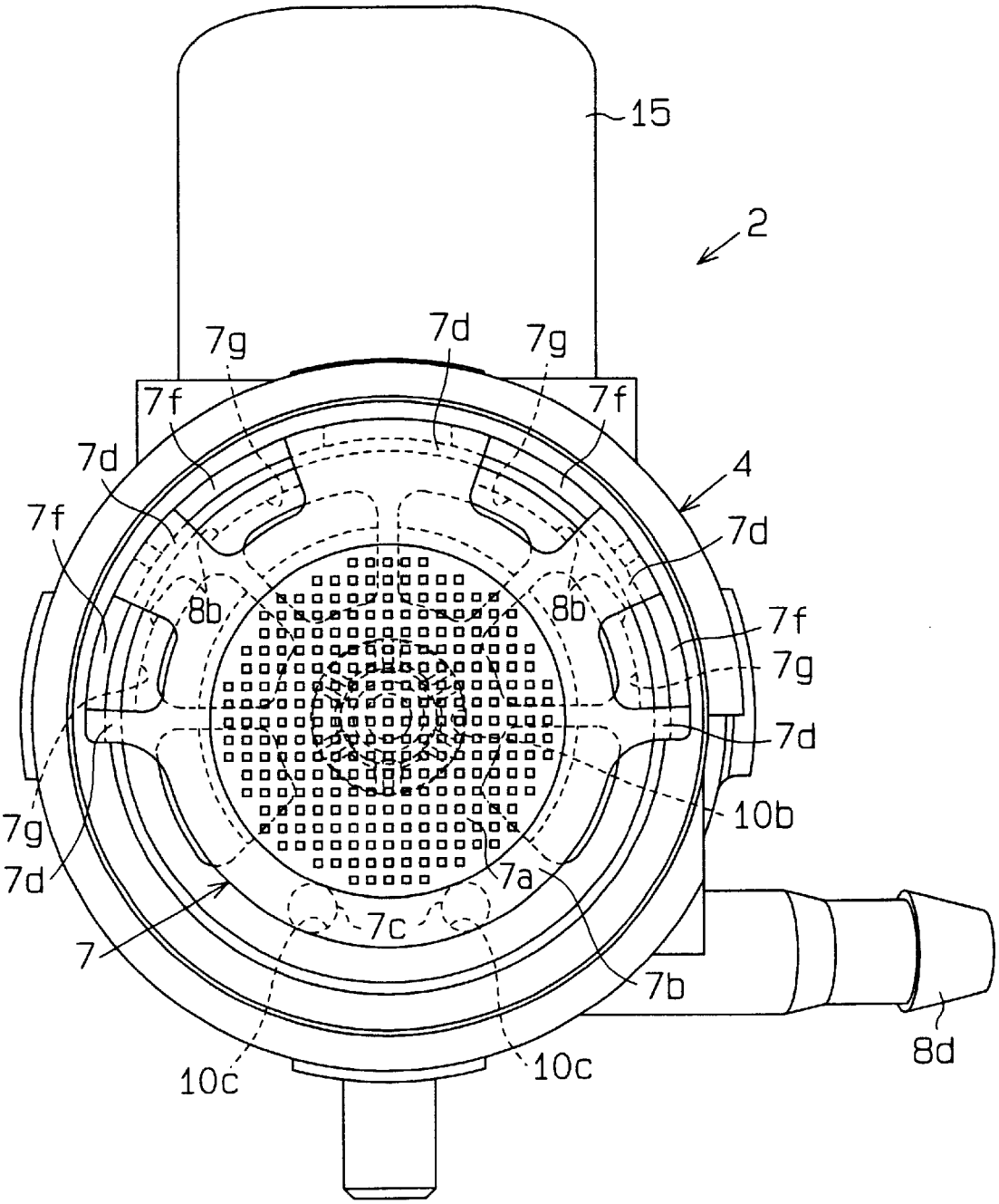
FIG. 2 is a frontal view of the fluid pump device according to the embodiment.
Figure 3:
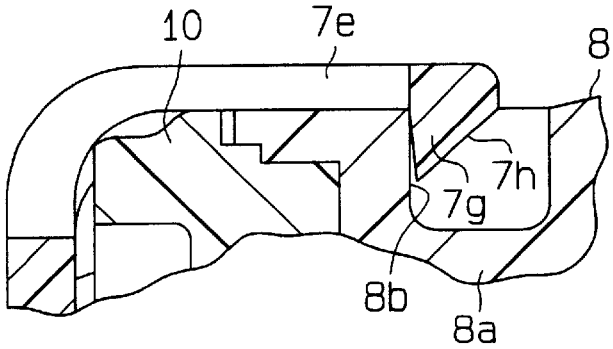
FIG. 3 is an enlarged partial cross sectional view depicting a coupling recess and a coupling projection of the embodiment.
Figure 4:
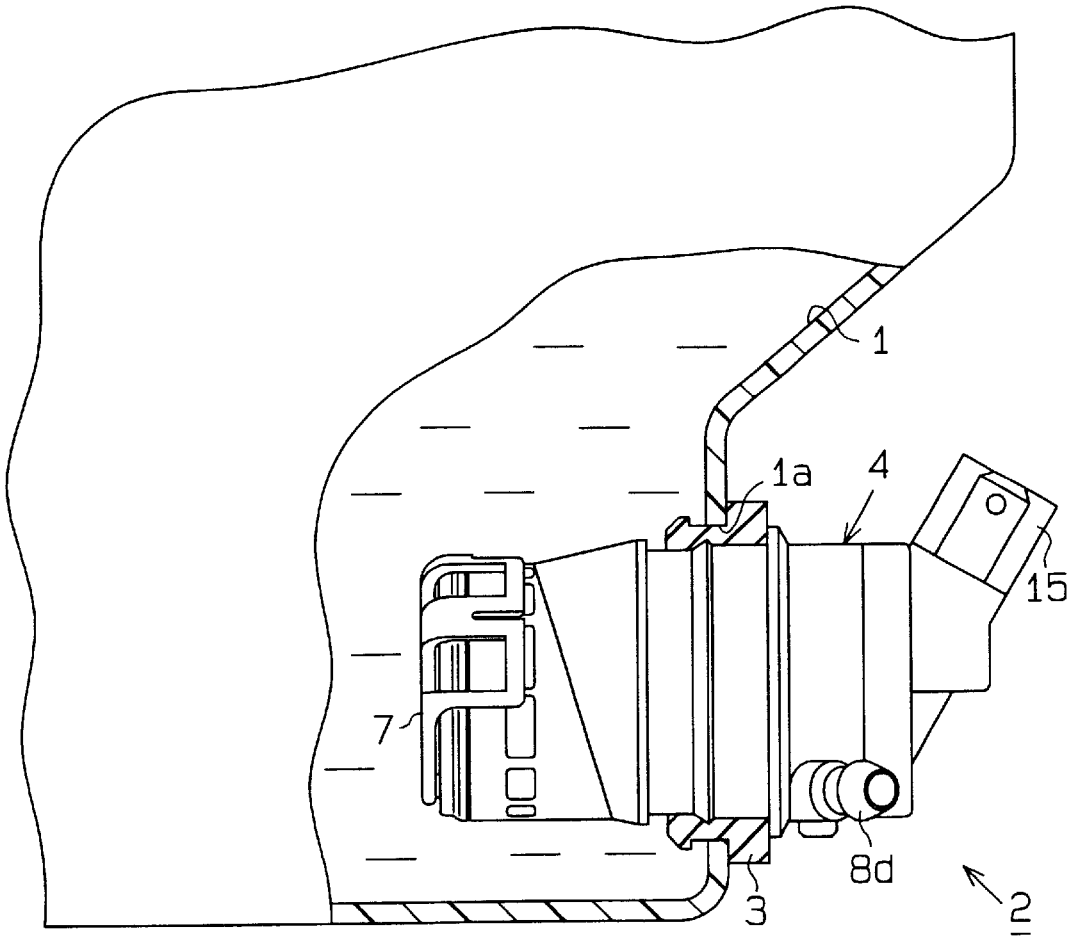
FIG. 4 is a partial cross sectional view of a washer apparatus of a vehicle having the fluid pump device according to the embodiment.

One embodiment of the present invention will be described with reference to a windshield washer apparatus of a vehicle in connection with FIGS. 1 to 7. With reference to FIG. 4, the washer apparatus includes a tank 1 and a fluid pump device 2. A fluid supply opening (not shown) is formed at a top portion of the tank 1, and a receiving opening 1*a* is formed at a base portion of the tank 1. A middle portion of the fluid pump 2 is received in the receiving opening 1*a* via a grommet 3. Washer fluid is received within the tank 1.

Figure 1:
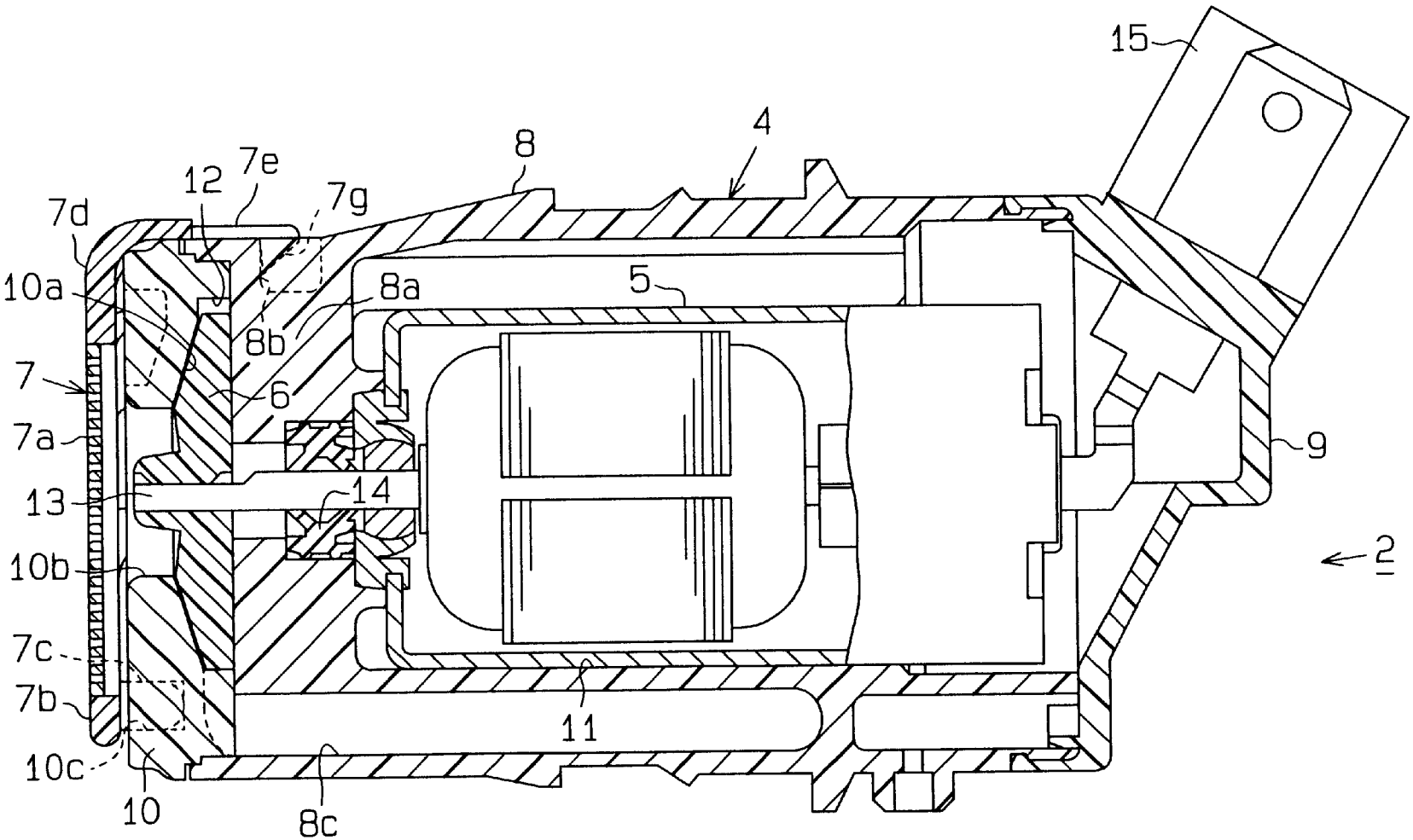
FIG. 1 is a longitudinal schematic cross sectional view of a fluid pump device according to an embodiment of the present invention.

With reference to FIG. 1, the fluid pump device 2 includes a housing 4, a motor 5, an impeller 6 and a filter 7. The housing 4 includes a main body 8, a cover 9 and a pump casing 10. The main body 8 is shaped into a generally cylindrical shape and has a reduced diameter portion 8*a* having a reduced inner diameter at a distal end (left end in FIG. 1) of the main body 8. As shown in FIGS. 2 and 3, coupling recesses 8*b*, which act as housing side coupling portions, are arranged along the outer peripheral surface of the reduced diameter portion 8*a* and radially extend toward a rotational axis of the impeller 6 (i.e., extend in a direction perpendicular to the rotational axis of the impeller 6). There are four coupling recesses 8*b* that are arranged within a range of 180 degrees in an upper part of the reduced diameter portion 8*a* (here, the term "upper part" is used to refer the upper part of the reduced diameter portion 8*a* when the fluid pump device 2 is oriented as shown in FIG. 4). The four coupling recesses 8*b* are symmetrically arranged in the reduced diameter portion 8*a* about a vertical center line (i.e., the vertical center line of the main body 8 in FIG. 2).

The cover 9 is secured to the base end portion (right end portion in FIG. 1) of the main body 8, and the pump casing 10 is secured to the distal end portion (reduced diameter portion 8*a*) of the main body 8. The motor chamber 11 is defined between an inner part of the main body 8 and the cover 9. A pump chamber 12 is defined between the distal end surface of the main body 8 and a recess 10*a* formed in the pump casing 10. The pump chamber 12 is communicated with the outside of the fluid pump device 2 through a flow passage 8*c* formed at a lower part of the main body 8 (here, the term "lower part" is used to refer the lower part of the main body 8 when the fluid pump device 2 is oriented as shown in FIG. 4) and also through an outlet opening 8*d* arranged at the base end portion of the main body 8, as shown in FIGS. 2 and 4. The motor 5 is received within the motor chamber 11, and a distal end of a rotatable shaft 13 of the motor 5 extends into the pump chamber 12. A seal member 14 is arranged along an inner peripheral surface of the reduced diameter portion 8*a* to prevent intrusion of the fluid from the pump chamber 12 into the motor chamber 11. The motor 5 is electrically connected to a terminal 15 that protrudes outwardly from the cover 9.

In the pump chamber 12, an impeller 6 is secured around the distal end of the rotatable shaft 13.

An inlet opening 10*b* is formed at the center of one axial end of the pump casing 10 (i.e., at a bottom side of the recess 10*a*) to extend in an axial direction of the impeller 6. The inlet opening 10*b* communicates between the inside and outside of the pump chamber 12 with each other. Engaging recesses 10*c*, which act as housing side engaging portions, are also formed at the one axial end of the pump casing 10 and extend in the axial direction of the impeller 6. The engaging recesses 10*c* are positioned in the pump casing 10 away from the rotational axis of the impeller 6 (or the rotational axis of rotatable shaft 13). With reference to FIG. 2, there are two engaging recesses 10*c* arranged at predetermined angular positions in the lower part of the pump casing 10 (here, the term "lower part" is used to refer the lower part of the pump casing 10 when the fluid pump device 2 is oriented as shown in FIG. 4), respectively. In the pump casing 10, the two engaging recesses 10*c* are symmetrically arranged about the vertical center line (i.e., the vertical center line of the pump casing 10 shown in FIG. 2). That is, the four coupling recesses 8*b* are opposed to the two engaging recesses 10*c* in the vertical direction in FIG. 2 (the circumferential center of the four coupling recesses 8*b* is displaced by about 180 degrees with respect to the circumferential center of the two engaging recesses 10*c*).

With reference to FIGS. 1–3 and 5–7, the filter 7 includes a meshed portion 7*a*, an outer peripheral portion 7*b*, engaging projections 7*c* acting as filter side engaging portions, extended portions 7*d*, arm portions 7*e*, connecting portions 7*f* and coupling projections 7*g* acting as filter side coupling portions.

The meshed portion 7*a* is a disc shaped plate having a plurality of through holes that penetrate through the disc shaped plate in the axial direction of the impeller 6. The meshed portion 7*a* covers the inlet opening 10*b,* as shown in FIGS. 1 and 2. The outer peripheral portion 7*b* has an annular form, which circumferentially extends along an entire periphery of the meshed portion 7*a* and radially extends outwardly.

At predetermined angular positions (lower side in FIG. 1 or 2) in the outer peripheral portion 7*b,* there are two engaging projections 7*c* that engage with the corresponding engaging recesses 10*c* in a direction generally perpendicular to the rotational axis of the impeller 6.

There are five extended portions 7*d* that extend radially lip outwardly from the outer peripheral portion 7*b* and are positioned at predetermined angular positions where no engaging projection 7*c* is located. As shown in FIG. 2, when the engaging projections 7*c* are engaged with the engaging recesses 10*c,* the five extended portions 7*d* are arranged within a range of about 180 degrees in an upper part of the outer peripheral portion 7*b* and are circumferentially arranged at the corresponding angular positions where none of the four coupling recesses 8*b* is located (i.e., each extended portion 7*d* is positioned at the angular position located between the corresponding adjacent two coupling recesses 8*b*). Each adjacent two extended portions 7*d* are paired. Each arm portion 7*e* (FIGS. 6 and 7) is provided at a distal end of a corresponding one of the extended portions 7*d* and extends in a direction generally perpendicular to the extended portion 7*d* (i.e., in the axial direction of the impeller 6).

Each arm portion 7*e* is resiliently flexible. Specifically, each arm portion 7*e* can be flexed for a predetermined angle about a corresponding corner of the meshed portion 7*a* to allow flexion of the arm portion 7*e* in the radially outer direction.

Figure 5:
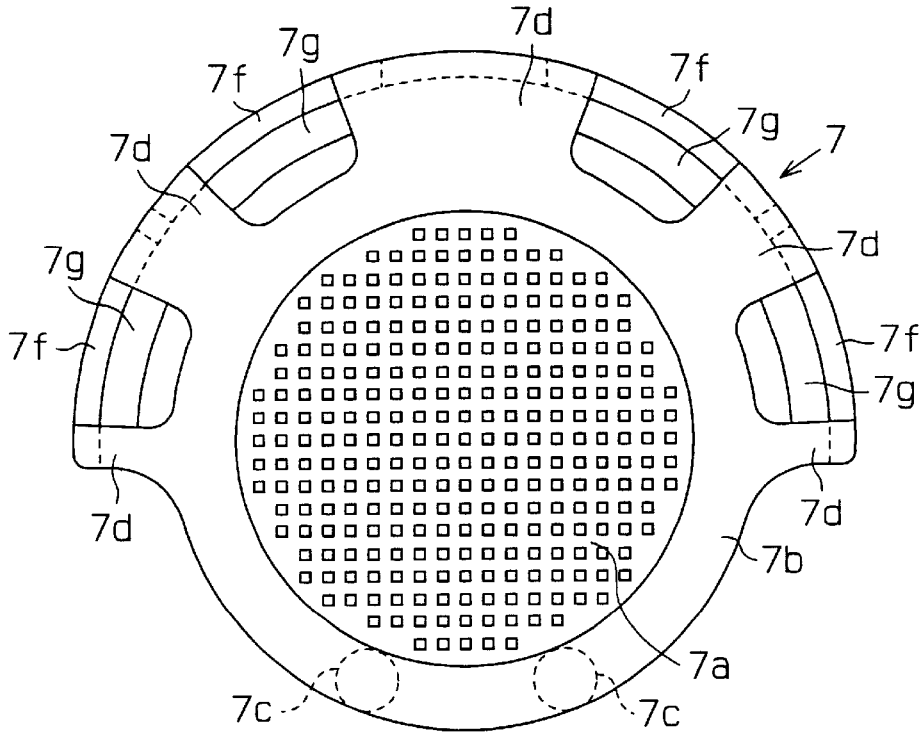
FIG. 5 is a frontal view of a filter of the fluid pump device according to the embodiment.
Figure 6:
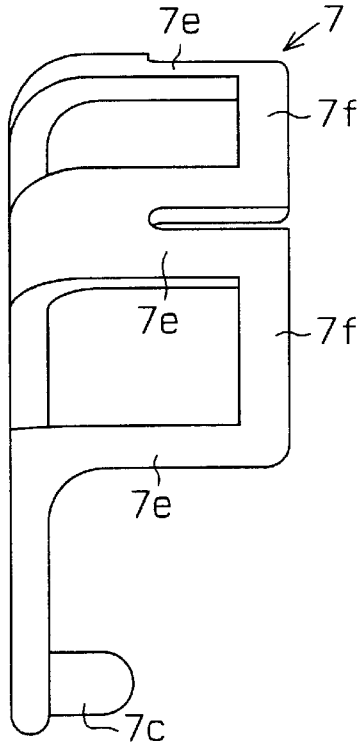
FIG. 6 is a side view of the filter according to the embodiment.
Figure 7:
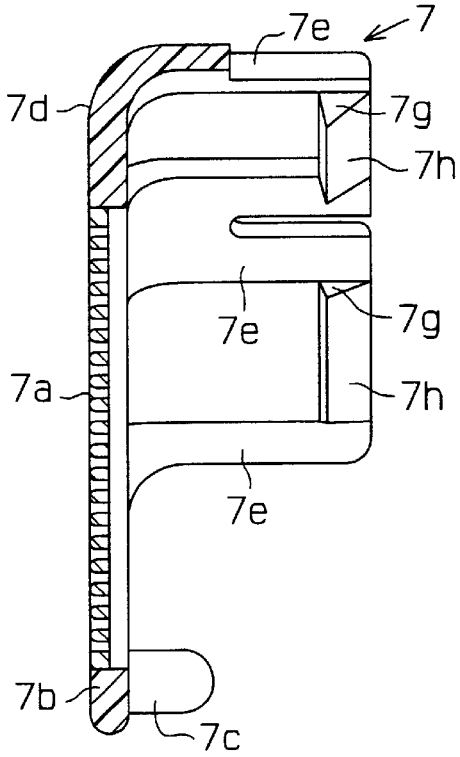
FIG. 7 is a longitudinal cross sectional view of the filter according to the embodiment.
Figure 8:
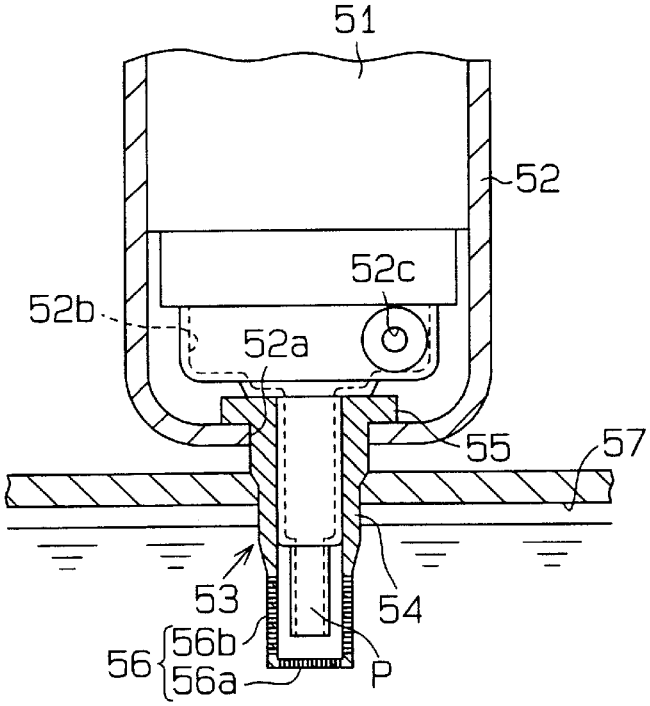
FIG. 8 RELATED ART
FIG. 8 is a partial cross sectional view showing a previously proposed fluid pump device.

The distal ends of paired arm portions 7*e* are connected together by a corresponding one of the arcuate connecting portions 7*f,* as shown in FIGS. 5 and 6. Each arcuate connecting portion 7*f* has the corresponding coupling projection 7*g* that extends toward the rotational axis of the impeller 6 and acts as the filter side coupling portion. As shown in FIG. 7, each coupling projection 7*g* has a tapered surface 7*h* that is tapered in a direction away from the meshed portion 7*a* toward a distal end of the coupling projection 7*g,* so that each coupling projection 7*g* has a claw-like shape. As shown in FIG. 5, each coupling projection 7*g* is circumferentially placed between the adjacent two extended portions 7*d,* so that the entire coupling projection 7*g* can be seen from the one axial end of the filter 7 (left end in FIG. 1). As shown in FIG. 3, each coupling projection 7*g* engages with the corresponding coupling recess 8*b* in the axial direction of the impeller 6.

When the engaging projections 7*c* are engaged with the corresponding engaging recesses 10*c,* and the coupling projections 7*g* are engaged with the corresponding coupling recesses 8*b,* the filter 7 is secured to the housing 4.

The filter 7 is easily installed or secured to the main body 8 by pressing an upper part of the outer peripheral portion 7*b* in the axial direction of the impeller 6 to snap fit the coupling projections 7*g* within the corresponding coupling recesses 8*b* while the engaging projections 7*c* are at least partially received within the engaging recesses 10*c* (here, only distal ends of the engaging projections 7*c* may be inserted in the corresponding engaging recesses 10*c*). During the installation of the filter 7, due to the tapered surface 7*h* of each coupling projection 7*g* and the resiliency of the adjacent arm portions 7*e,* each coupling projection 7*g* can be easily moved to a point where the coupling projection 7*g* is engaged with the corresponding coupling recess 8*b* only by pressing the upper part of the outer peripheral portion 7*b* in the axial direction of the impeller 6 to flex the arm portions 7*e* without need for applying a force in any other direction. Thus, each coupling projection 7*g* can be easily engaged with the corresponding coupling recess 8*b*.

In the washer apparatus constructed in the above manner, when the motor 5 of the fluid pump device 2 is driven to rotate the impeller 6, the washer fluid in the tank 1 is suctioned into the pump chamber 12 through the meshed portion 7*a* of the filter 7 and is then discharged from the housing 4 through the flow passage 8*c* and the outlet opening 8*d.* As a result, the washer fluid is discharged toward a windshield of the vehicle through a hose (not shown), which is secured to the outlet opening 8*d,* and washer nozzles (not shown). During this stage, the washer fluid, from which the debris and the other undesirable foreign objects are removed by the meshed portion 7*a,* is suctioned into the pump, chamber 12. Thus, the fluid pump device 2 and washer nozzles (not shown) are prevented from clogging with the debris and the other undesirable foreign objects.

Characteristic advantages of the above embodiment will be described.

(1) The meshed portion 7*a* of the filter 7 is arranged to cover the inlet opening 10*b* formed in the center of the one axial end of the pump casing 10 of the housing 4. With this arrangement, an operating efficiency of the fluid pump device of the present embodiment is improved in comparison to the previously proposed fluid pump device that suctions the washer fluid through the elongated suction tube.

(2) The meshed portion 7*a* of the filter 7 is arranged to cover the inlet opening 10*b* formed in the center of the one axial end of the pump casing 10 of the housing 4, as described above. With this arrangement, it is possible to reduce a size of the device in the axial direction of the impeller 6 in comparison to the previously proposed one that suctions the washer fluid through the elongated suction tube. Also, the size can be reduced in the radial direction in comparison to the previously proposed one that has the meshed peripheral wall portion provided with the through holes penetrating therethrough in the radial direction.

(3) The meshed portion 7*a* of the filter 7 is arranged to cover the inlet opening 10*b* formed in the center of the one axial end of the pump casing 10 of the housing 4, as described above. With this arrangement, the meshed portion 7*a* of the filter 7 can be easily formed with a mold in comparison to the previously proposed fluid pump device that has the meshed portion provided with both the axially extending through holes and the radially extending through holes.

(4) The meshed portion 7*a* of the filter 7 is arranged to cover the inlet opening 10*b* formed in the center of the one axial end of the pump casing 10 of the housing 4, as discussed above. With this arrangement, the meshed portion 7*a* of the filter 7 does not affect the attachment of the fluid pump device to the tank unlike the previously proposed fluid pump device that has the filter extending from the distal end of the fluid pump device. Thus, if the meshed portion 7*a* is not required (if removal of the debris and the other undesirable foreign objects from the washer fluid is not required), the fluid pump device of the present embodiment can be used without the filter 7. Thus, the fluid pump device of the present embodiment can be more universally used, allowing a reduction in a manufacturing cost.

(5) The arm portions 7*e* of the filter 7, which are resiliently flexible, extend perpendicularly to the meshed portion 7*a* and have the coupling projections 7*g* that are engaged with the corresponding coupling recesses 8*b* in the axial direction of the impeller 6. With this arrangement, the coupling projections 7*g* of the filter 7 can be easily engaged with the corresponding coupling recesses 8*b* of the main body 8 by resiliently flexing the arm portions 7*e* of the filter 7. Furthermore, in the present embodiment, each coupling projection 7*g* is provided with the tapered surface 7*h,* so that each coupling projection 7*g* can be easily snap fit within the corresponding coupling recess 8*b* by pressing the upper part of the outer peripheral portion 7*b* in the axial direction of the impeller 6 (without need for applying a force in any other direction) to resiliently flex the arm portions 7*e* in the radially outer directions. Thus, the coupling projections 7*g* can be easily engaged with the corresponding coupling recesses 8*b.*

(6) The engaging recesses 10*c* and the engaging projections 7*c* are opposed to the coupling recesses 8*b* and the coupling projections 7*g* in the vertical direction (i.e., the circumferential center of the four coupling recesses 8*b,* and hence the circumferential center of the four coupling projections 7*g,* is displaced by about 180 degrees with respect to the circumferential center of the two engaging recesses 10*c,* and hence with respect to the circumferential center of the two engaging projections 7*c*). That is, the filter 7 engages the housing 4 at the predetermined two angular positions located away from the rotational axis of the impeller 6. At the one angular position (first predetermined angular position), the filter 7 engages the housing 4 in the direction perpendicular to the axial direction of the impeller 6. At the other angular position (second predetermined angular position) that is displaced by about 180 degrees with respect to the one angular position, the filter 7 engages the housing 4 in the axial direction of the impeller 6. Thus, the filter 7 is more securely engaged with the housing 4 and hence is not easily detached from the housing 4.

(7) The plurality (two in this embodiment) of the engaging recesses 10*c* and the corresponding number of the engaging projections 7*c* are provided, so that the filter 7 is securely engaged with the housing 4 in the direction perpendicular to the axial direction of the impeller 6. Thus, the relative movement of the filter 7 with respect to the housing 4 in the direction perpendicular to the axial direction of the impeller 6 is reduced.

(8) The plurality (four in this embodiment) of the coupling recesses 8*b* and the corresponding number of the coupling projections 7*g* are provided, so that the filter 7 is securely engaged with the housing 4 in the axial direction of the impeller 6. Thus, the relative movement of the filter 7 with respect to the housing 4 in the axial direction of the impeller 6 is reduced.

(9) The coupling recesses 8*b* and the coupling projections 7*g* are symmetrically arranged about the vertical center line of the filter 7 (i.e., the straight line connecting between the rotational axis of impeller 6 and the circumferential center of the engaging recesses 10*c,* and hence the circumferential center of the engaging projections 7*c*), so that the unintentional detachment of the filter 7 from the housing 4 is further restrained.

(10) Each arm portion 7*e* extends perpendicularly from the distal end of the corresponding extended portion 7*d* that extends radially outwardly. Furthermore, each coupling projection 7*g* extends from the connection portion 7*f,* which connects the corresponding pair of the arm portions 7*e,* toward the rotational axis of the impeller 6, so that each coupling projection 7*g* is circumferentially placed between the adjacent two extended portions 7*d* (i.e., the entire coupling projection 7*g* can be seen from the one axial end of the filter 7), as shown in FIG. 5. Thus, in the manufacturing of the filter 7, the mold for molding the filter 7 can be removed from the molded filter 7 in the axial direction, allowing easy one-piece molding of the filter 7 with use of the mold. Furthermore, the meshed portion 7*a* is formed as the plate having the through holes that extend in the axial direction of the impeller 6. Thus, the meshed portion 7*g* can be molded integrally with the coupling projections 7*g* with a couple of molds that move in the axial direction.

(11) Because of the engaging projections 7*c* and the coupling projections 7*g* of the filter 7 and the engaging recesses 10*c* and the coupling recesses 8*b* of the housing 4, the filter 7 can be easily secured to the housing 4 by installing (moving) the filter 7 to the housing 4 in the axial direction of the impeller 6 without requiring any other movement.

The above embodiment can be modified as follows.

In the above embodiment, the two engaging recesses 10*c* and the two engaging projections 7*c* are opposed to the four coupling recesses 8*b* and the four coupling projections 7*g* in the vertical direction (i.e., the circumferential center of the four coupling recesses 8*b,* and hence the circumferential center of the four coupling projections 7*g,* is displaced by about 180 degrees with respect to or is diametrically opposed to the circumferential center of the two engaging recesses 10*c,* and hence the circumferential center of the two engaging projections 7*c*). However, the two engaging recesses 10*c* and the two engaging projections 7*c* can be opposed to the four coupling recesses 8*b* and the four coupling projections 7*g* at different locations. For example, the two engaging recesses 10*c* and the two engaging projections 7*c* can be opposed to the four coupling recesses 8*b* and the four coupling projections 7*g* in the horizontal direction (here, the term "horizontal direction" is used to refer the horizontal direction that is defined when the fluid pump device 2 is oriented as shown in FIG. 4). Even with this modification, the advantages similar to those discussed in the above embodiment can be achieved. Furthermore, the engaging recesses 10*c* and the engaging projections 7*c* are not required to diametrically oppose the coupling recesses 8*b* and the coupling projections 7*g.* That is, the engaging recesses 10*c* and the engaging projections 7*c* can have any positional relationship with the coupling recesses 8*b* and the coupling projections 7*g* other than the diametrically opposed relationship. Even with this modification, the advantages similar to those discussed in the above sections (1)–(5), (7) (8), (10) and (11) can be achieved.

In the above embodiment, the two engaging recesses 10*c* and the two engaging projections 7*c* are provided. However, the number of the engaging recesses 10*c* and the number of the engaging projections 7*c* are not limited to two and can be modified to any number, such as three or four. Even with this modification, the advantages similar to those discussed in the above embodiment can be achieved.

In the above embodiment, the plurality (two) of engaging recesses 10*c* and the plurality of (two) engaging projections 7*c* are provided. However, only one engaging recess 10*c* and only one engaging projection 7*c* can be provided. Even with this modification, the advantages similar to those discussed in the above sections (1)–(6) and (8)–(11) can be achieved.

In the above embodiment, the four coupling recesses 8*b* and the four coupling projections 7*g* are provided. However, the number of the coupling recesses 8*b* and the number of the coupling projections 7*g* are not limited to four and can be modified to any number, such as two or five. Even with this modification, the advantages similar to those discussed in the above embodiment can be achieved.

In the above embodiment, the plurality (four) of coupling recesses 8*b* and the plurality (four) of coupling projections 7*g* are provided. However, only one coupling recess 8*b* and only one coupling projection 7*g* can be provided. Even with this modification, the advantages similar to those discussed in the above sections (1)–(7), (10) and (11) can be achieved.

p In the above embodiment, the coupling recesses 8*b* and the coupling projections 7*g* are symmetrically arranged about the vertical center line of the filter 7 (i.e., the line connecting between the rotational axis of the impeller 6 and the circumferential center of the engaging recesses 10*c,* and hence the circumferential center of the engaging projections 7*c*). However, the coupling recesses 8*b* as well as the coupling projections 7*g* can be non-symmetrically arranged about the vertical center line. Even with this arrangement, the advantages similar to, those discussed in the above sections (1)–(8), (10) and (11) can be achieved.

In the above embodiment, each coupling projection 7*g* is circumferentially placed between the adjacent two extended portions 7*d,* as shown in FIG. 5. However, each coupling projection 7*g* can be placed at any other circumferential location (i.e., each coupling projection 7*g* needs not be seen from the one axial end of the filter 7). For example, the five extended portions 7*d* can be replaced with one continuous fan-like portion that circumferentially extends for about 180 degrees, and the arm portions 7*e* can be formed in the fan-like portion. In such a case, the corresponding mold cannot be removed from the molded filter 7 in the axial direction because of the coupling projections 7*g,* so that the coupling projections 7*g* may need to be separately manufactured in a separate step. Even with this modification, the advantages similar to those discussed in the above sections (1)–(9), and (11) can be achieved.

In the above embodiment, the engaging recesses 10*c* are provided as the housing side engaging portions in the housing 4, and the engaging projections 7*c* are provided as the filter side engaging projections in the filter 7. However, as long as they can engage with each other in the direction perpendicular to the axial direction of the impeller 6, they can have any other arrangements. For example, engaging projections acting as housing side engaging portions can be formed in the housing 4, and engaging recesses acting as filter side engaging portions can be formed in the filter 7.

In the above embodiment, the coupling recesses 8*b* are provided as the housing side coupling portions in the housing 4, and the coupling projections 7*g* are provided as the filter side coupling projections in the filter 7. However, as long as they can engage with each other in the axial direction of the impeller 6, they can have any other arrangements. For example, coupling projections acting as housing side coupling portions can be formed in the housing 4, and coupling recesses acting as filter side coupling portions can be formed in the filter 7.

In the above embodiment, the invention is embodied in the washer apparatus of the vehicle having the fluid pump device 2. However, the fluid pump device 2 can be provided in any other apparatus.

Additional advantages and modifications will readily occur to those skilled in the art. The invention in its broader terms is therefore, not limited to the specific details, representative apparatus, and illustrative examples shown and described.

What is claimed is:

1. A fluid pump device comprising:

an impeller for creating a flow of fluid upon rotation of said impeller about its rotational axis;

a housing that receives said impeller therein, said housing having:

an inlet opening formed at one axial end of said housing, said flow of said fluid moving into said housing through said inlet opening;

at least one housing side engaging portion; and at least one housing side coupling portion; and a filter secured to said housing, said filter having:

a meshed portion communicated with said inlet opening of said housing to filter said fluid, said meshed portion substantially covering said inlet opening of said housing;

at least one filter side engaging portion that is engaged with said at least one housing side engaging portion in a direction perpendicular to an axial direction of said impeller and also in a circumferential direction of said impeller by installing said filter to said housing in said axial direction of said impeller; and at least one filter side coupling portion that is engaged with said at least one housing side coupling portion in said axial direction of said impeller by installing said filter to said housing in said axial direction of said impeller, wherein said filter is secured to said housing upon engagement between said at least one filter side engaging portion and said at least one housing side engaging portion and also upon engagement between said at least one filter side coupling portion and said at least one housing side coupling portion.

2. A fluid pump device according to claim 1, wherein:

said at least one housing side engaging portion and said at least one filter side engaging portion are respectively, circumferentially centered at a first predetermined angular position that is radially spaced away from said rotational axis of said impeller; and said at least one housing side coupling portion and said at least one filter side coupling portion are respectively, circumferentially centered at a second predetermined angular position that is radially spaced away from said rotational axis of said impeller and is opposed to said first predetermined angular position with respect to said rotational axis of said impeller.

3. A fluid pump device comprising:

an impeller for creating a flow of fluid upon rotation of said impeller about its rotational axis;

a housing that receives said impeller therein, said housing having:

an inlet opening formed at one axial end of said housing, said flow of said fluid moving into said housing through said inlet opening;

at least one housing side engaging portion formed at said one axial end of said housing to extend in an axial direction of said impeller; and at least one housing side coupling portion formed in an outer peripheral surface of said housing to extend in a direction perpendicular to said axial direction of said impeller; and a filter secured to said housing, said filter having:

a meshed portion communicated with said inlet opening of said housing to filter said fluid, said meshed portion substantialily covering said inlet opening of said housing;

at least one filter side engaging portion engaged with said at least one housing side engaging portion in said direction perpendicular to said axial direction of said impeller;

at least one arm portion substantially, perpendicularly extending with respect to said meshed portion of said filter and being resiliently flexible in said direction perpendicular to said axial direction of said impeller; and at least one filter side coupling portion provided to said at least one arm portion and engaged with said at least one housing side coupling portion in said axial direction of said impeller, wherein said filter is secured to said housing upon engagement between said at least one filter side engaging portion and said at least one housing side engaging portion and also upon engagement between said at least one filter side coupling portion and said at least one housing side coupling portion.

4. A fluid pump device according to claim 3, wherein:

said at least one housing side engaging portion and said at least one filter side engaging portion are respectively, circumferentially centered at a first predetermined angular position that is radially spaced away from said rotational axis of said impeller; and said at least one housing side coupling portion and said at least one filter side coupling portion are respectively, circumferentially centered at a second predetermined angular position that is radially spaced away from said rotational axis of said impeller and is displaced by about 180 degrees with respect to said first predetermined angular position.

5. A fluid pump device according to claim 3, wherein:

said at least one housing side engaging portion includes a plurality of housing side engaging portions; and said at least one filter side engaging portion includes a plurality of filter side engaging portions.

6. A fluid pump device according to claim 3, wherein:

said at least one housing side coupling portion includes a plurality of housing side coupling portions; and said at least one filter side coupling portion includes a plurality of filter side coupling portions.

7. A fluid pump device according to claim 3, wherein said at least one housing side coupling portion as well as said at least one filter side coupling portion are respectively, symmetrically arranged about a straight line that extends through said rotational axis of said impeller, through a circumferential center of said at least one housing side engaging portion, and also through a circumferential center of said at least one filter side engaging portion.

8. A fluid pump device according to claim 3, wherein:

said at least one housing side coupling portion is in a form of a coupling recess;

said at least one filter side coupling portion is in a form of a coupling projection;

said filter further includes two or more extended portions that extend radially outwardly away from said meshed portion;

said at least one arm portion includes two ore more arm portions that extend from said two or more extended portions, respectively; and each one of said at least one filter side coupling portion is circumferentially placed between corresponding adjacent two of said two or more arm portions.

9. A fluid pump device according to claim 8, wherein said at least one filter side coupling portion has a tapered surface that is tapered in a direction away from said meshed portion of said filter.

* * * * *